US008104760B2

(12) United States Patent
Hamasaki et al.

(10) Patent No.: US 8,104,760 B2
(45) Date of Patent: Jan. 31, 2012

(54) AUTOMATIC DOCUMENT TRANSPORT DEVICE, IMAGE READING DEVICE, AND IMAGE FORMING APPARATUS

(75) Inventors: Nobutoshi Hamasaki, Kanagawa (JP); SengGyu Cho, Incheon (KR); DukHyun Ko, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/953,589

(22) Filed: Nov. 24, 2010

(65) Prior Publication Data

US 2011/0316217 A1 Dec. 29, 2011

(30) Foreign Application Priority Data

Jun. 25, 2010 (JP) ..... 2010-144951

(51) Int. Cl.
*B65H 5/22* (2006.01)

(52) U.S. Cl. ..... 271/3.14; 271/3.2

(58) Field of Classification Search ..... 271/3.14, 271/3.2, 3.18, 4.01; 399/367
See application file for complete search history.

(56) References Cited

U.S. PATENT DOCUMENTS

| | | | | |
|---|---|---|---|---|
| 2005/0058477 | A1* | 3/2005 | Aoki et al. | 399/367 |
| 2005/0158091 | A1* | 7/2005 | Oya et al. | 399/367 |
| 2006/0110197 | A1* | 5/2006 | Nose et al. | 399/367 |
| 2007/0145662 | A1* | 6/2007 | Yamada | 271/3.2 |

FOREIGN PATENT DOCUMENTS

| | | | |
|---|---|---|---|
| JP | 2004-123354 | A | 4/2004 |
| JP | 2004-336275 | A | 11/2004 |
| JP | 4214515 | B2 | 12/2004 |

* cited by examiner

*Primary Examiner* — David H Bollinger
(74) *Attorney, Agent, or Firm* — Sughrue Mion, PLLC

(57) ABSTRACT

An automatic document transport device includes a document stacker that is movable between a stacking position and an open position; a document transport path; a document feed member; a document output section; a document output member disposed downstream of an image reading position, the document output member including upper and lower output members; and a shielding member disposed above a document output slot and between the document output member and the document output section, the shielding member including first and second shielding portions, the first shielding portion extending upward and having a lower end disposed above a region in which the upper and lower output members contact each other, the second shielding portion extending downstream from the lower end of the first shielding portion, the shielding member shielding the upper output member from a space between the document stacker and the document output section.

14 Claims, 9 Drawing Sheets

AUTOMATIC DOCUMENT TRANSPORT DEVICE, IMAGE READING DEVICE, AND IMAGE FORMING APPARATUS

CROSS-REFERENCE TO RELATED APPLICATIONS

This application is based on and claims priority under 35 USC 119 from Japanese Patent Application No. 2010-144951 filed Jun. 25, 2010.

BACKGROUND

The present invention relates to an automatic document transport device, an image reading device, and an image forming apparatus.

SUMMARY

According to an aspect of the invention, an automatic document transport device includes a document stacker on which a document having a document image recorded thereon is stacked, the document stacker being supported so as to be movable between a stacking position and an open position, the stacking position being a position in which the document stacker allows the document to be stacked thereon, and the open position being a position in which a space below the document stacker with respect to a direction of gravity is opened; a document transport path connected to the document stacker and through which the document stacked on the document stacker is transported; a document feed member that feeds the document stacked on the document stacker to an image reading position at which the document image recorded on the document is read, the image reading position being preset on the document transport path; a document output section to which the document is output, the document output section being disposed downstream of the document transport path with respect to a document transport direction and below the document stacker with respect to the direction of gravity; a document output member disposed downstream of the image reading position with respect to the document transport direction, the document output member outputting the document whose document image has been read to the document output section, and the document output member including an upper output member and a lower output member, the upper output member being disposed above the document transport path with respect to the direction of gravity, and the lower output member facing the upper output member and being disposed below the document transport path with respect to the direction of gravity; and a shielding member disposed above a document output slot with respect to the direction of gravity, the document output slot being disposed at a downstream end of the document transport path with respect to the document transport direction, the shielding member being disposed between the document output member and the document output section with respect to the document transport direction, the shielding member including a first shielding portion and a second shielding portion, the first shielding portion extending upward and having a lower end with respect to the direction of gravity disposed above a region in which the upper output member and the lower output member contact each other with respect to the direction of gravity, the second shielding portion extending downstream with respect to the document transport direction from the lower end of the first shielding portion with respect to the direction of gravity, and the shielding member shielding the upper output member from a space between the document stacker and the document output section.

BRIEF DESCRIPTION OF THE DRAWINGS

Exemplary embodiments of the present invention will be described in detail based on the following figures, wherein:

FIGS. 4A and 4B illustrate a document feed tray that is held in a stacking position, in which FIG. 4A illustrates the document feed tray and FIG. 4B illustrates a supporting member of the document feed tray viewed from the front side;

FIGS. 5A and 5B illustrate the document feed tray that is held in an open position, in which FIG. 5A illustrates the document feed tray and FIG. 5B illustrates the supporting member of the document feed tray viewed from the front side;

FIGS. 6A and 6B illustrate an elevation plate, in which

FIG. 6A illustrates the elevation plate when documents are placed thereon and FIG. 6B illustrates the elevation plate when a document is being fed into a body of a document transport device;

DETAILED DESCRIPTION

Hereinafter, exemplary embodiments of the present invention will be described with reference to the figures. However, the present invention is not limited to the exemplary embodiments described below. For ease of understanding, in the figures, it is assumed that the front-back direction is the X axis direction, the left-right direction is the Y axis direction, and the up-down direction is the Z axis direction. The direction or the side indicated by arrows X, −X, Y, −Y, Z, and −Z will be referred to as front, back, right, left, up (above), and down (below), or, the front side, the back side, the right side, the left side, the upper side, and the lower side. In the figures, "○" containing "." represents an arrow extending from the back side to the front side of the paper surface, and "○" containing "x" represents an arrow extending from the front side to the back side of the paper surface. For ease of understanding, in the following description using the figures, illustration of members that are not necessary for the description are omitted.

First Exemplary Embodiment

Figure 1:
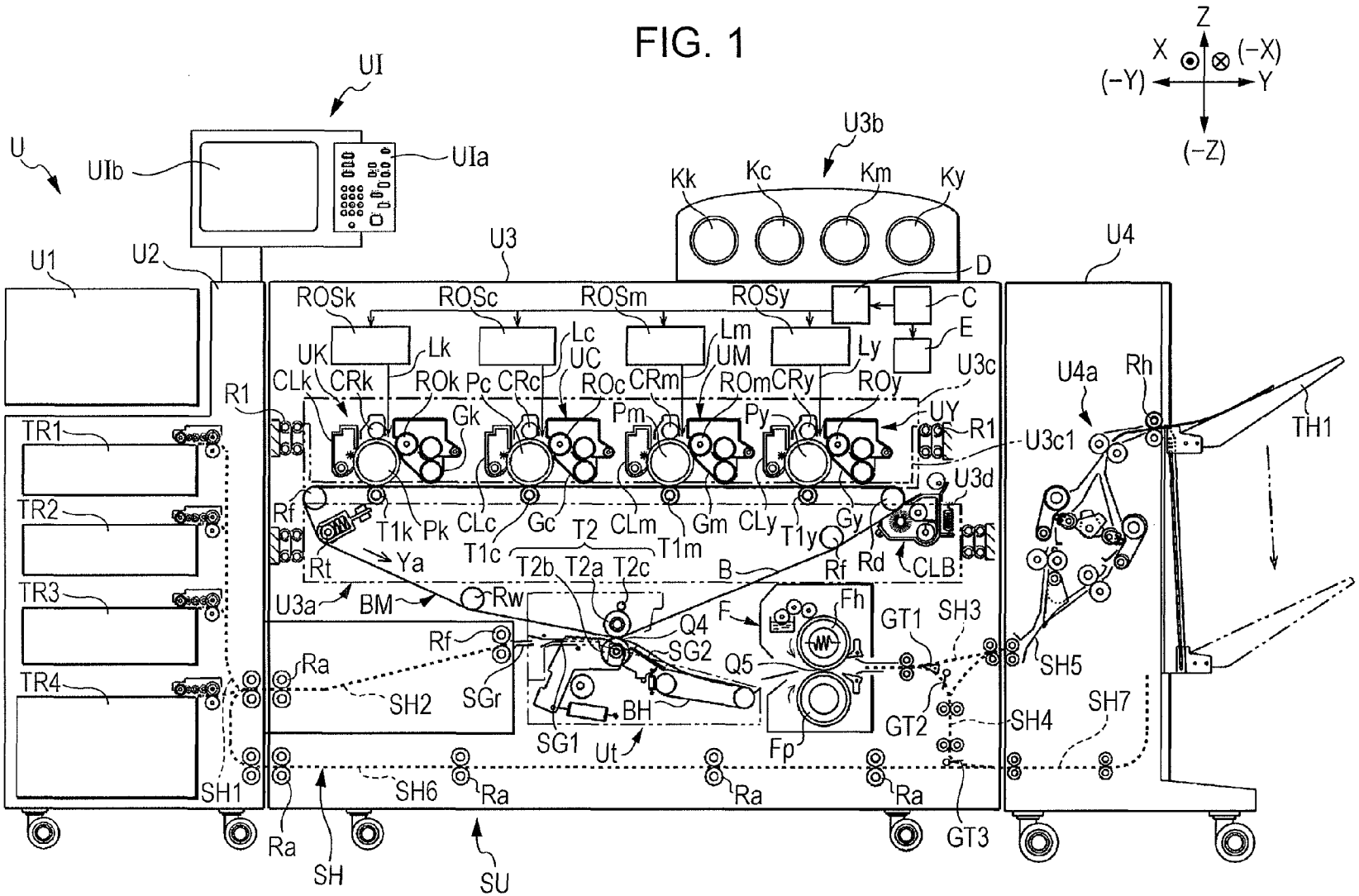
FIG. 1 is an overall view of an image forming apparatus according to a first exemplary embodiment of the present invention.
Figure 2:
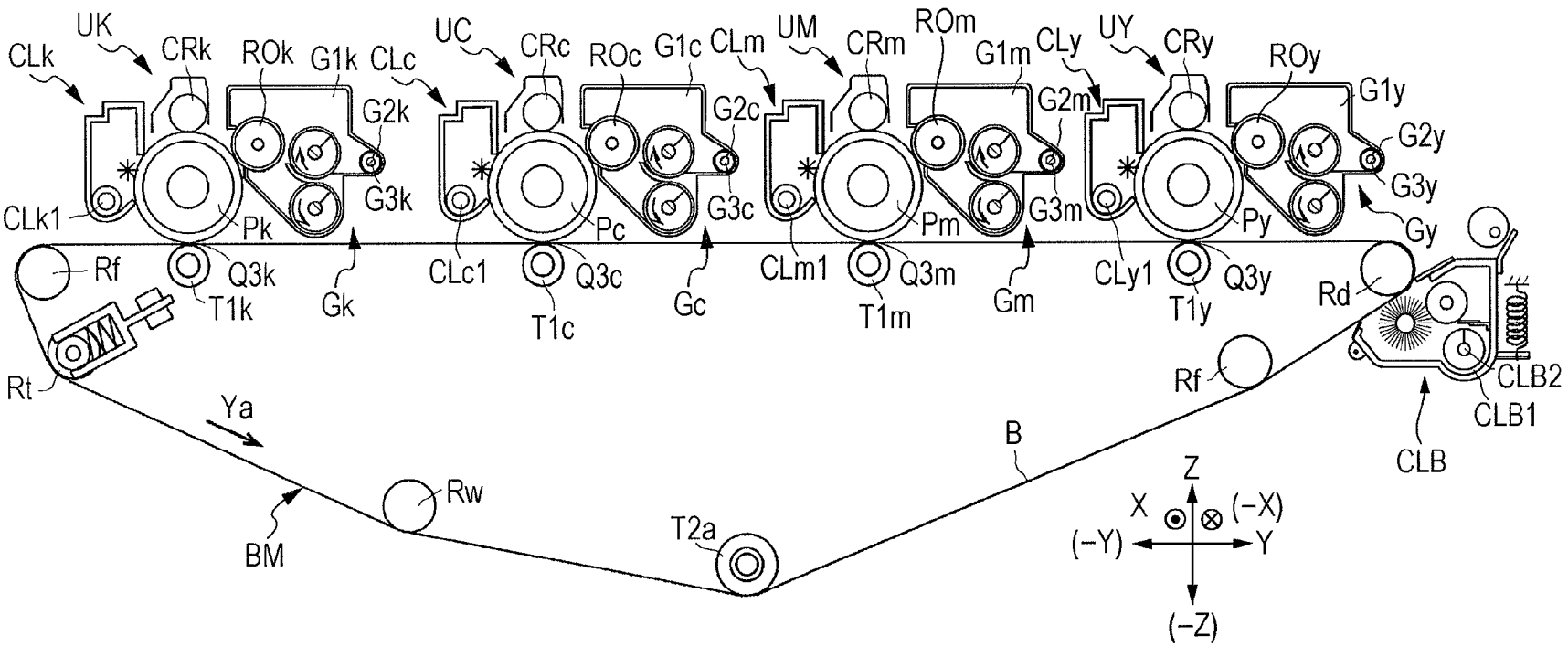
FIG. 2 is an enlarged view of a visible image forming device and an intermediate transfer body cleaner according to the first exemplary embodiment of the present invention.

FIG. 1 is an overall view of an image forming apparatus according to a first exemplary embodiment of the present invention. FIG. 2 is an enlarged view of a visible image forming device and an intermediate transfer body cleaner according to the first exemplary embodiment of the present invention. Referring to FIG. 1, a copier U, which is an example of an image forming apparatus, includes an operation unit UI, an image reading device U1, a medium feeding device U2, an image forming apparatus body U3, and a medium handling device U4.

Description of Operation Unit UI

The operation unit UI includes input buttons UIa that are used to start copying, setting the number of copies, and other operations. The operation unit UI includes a display UIb on which inputs to the input buttons UIa and a state of the copier U are displayed.

Description of Image Reading Device U1

Figure 3:
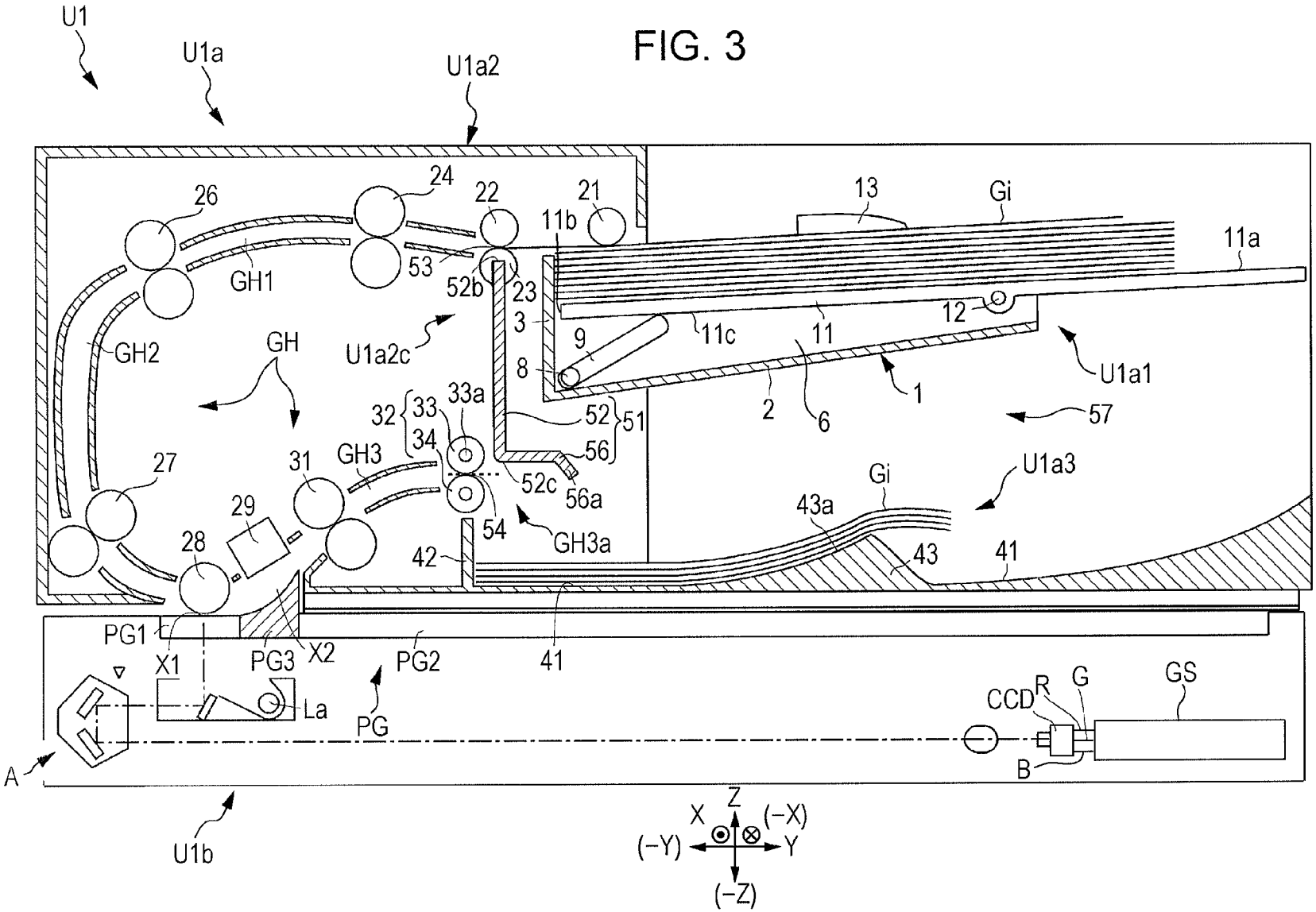
FIG. 3 is an overall view of an image reading device according to the first exemplary embodiment of the present invention.

FIG. 3 is an overall view of an image reading device according to the first exemplary embodiment of the present invention. Referring to FIGS. 1 and 3, the image reading device U1 includes an automatic document transport device U1*a* and a flatbed image reading unit U1*b* that supports the automatic document transport device U1*a*. The flatbed image reading unit U1*b* has a transparent document reading surface PG on an upper end thereof. The automatic document transport device Ula includes a document feed tray U1*a*1, a document transport apparatus body U1*a*2, and a document output tray U1*a*3. The document feed tray U1*a*1, which is an example of a document stacker, contains a stack of plural documents Gi. The document transport apparatus body U1*a*2 transports the document Gi, which has been fed from the document feed tray U1*a*1, onto the document reading surface PG. The document output tray U1*a*3 is an example of a document output section, to which the document Gi that has passed the document reading surface PG is output from the document transport apparatus body U1*a*2.

Referring to FIG. 3, the flatbed image reading unit U1*b* includes the document reading surface PG and an exposure optical system A. The document reading surface PG includes a transported-document reading surface PG1, which is disposed at an image reading position X1 that is preset in the left end portion thereof, and a placed-document reading surface PG2, which is disposed on the right side thereof. The transported-document reading surface PG1 is a reading surface over which the document Gi that is transported by the automatic document transport device U1*a* passes. The placed-document reading surface PG2 is a reading surface that supports the document Gi that is placed by a user. A transported-document guide portion PG3 is disposed between the transported-document reading surface PG1 and the placed-document reading surface PG2. The transported-document guide portion PG3 guides the document Gi that has passed the transported-document reading surface PG1 into the automatic document transport device U1*a*. When the document Gi passes over the transported-document reading surface PG1 or the document Gi is placed on the placed-document reading surface PG2, the document Gi is irradiated with light emitted from a lamp La through the document reading surface PG. The lamp La is an example of a light source. Reflected light from the document Gi, which is irradiated with light, passes through the exposure optical system A and converted to electric signals for red R, green G, and blue B by a solid-state image pickup device CCD. The electric signals are input to the image processing unit GS.

The image processing unit GS converts the electric signals for RGB, which have been input from the solid-state image pickup device CCD, to image information for black K, yellow Y, magenta M, and cyan C, and temporarily stores the image information. At a predetermined timing, the image processing unit GS outputs the image information to a latent image forming device driving circuit D as image information for forming a latent image. If the document image is a monochrome image, image information for only black K is input to the latent image forming device driving circuit D described below. The flatbed image reading unit U1*b* according to the first exemplary embodiment is constituted by the document reading surface PG, the exposure optical system A, the solid-state image pickup device CCD, and the image processing unit GS.

Description of Medium Feeding Device U2

Referring to FIG. 1, the medium feeding device U2 includes sheet feed trays TR1, TR2, TR3, and TR4, which are examples of a medium container. The medium feeding device U2 also includes a medium feeding path SH1 that picks up a recording sheet S contained in on of the sheet feed trays TR1 to TR4 and transports the recording sheet S to the image forming apparatus body U3. The recording sheet S is an example of an image recording medium.

Description of Image Forming Apparatus Body U3 and Medium Handling Device U4

Referring to FIG. 1, the image forming apparatus body U3 includes an image recording unit U3*a*, a developer supplying device U3*b*, a sheet transport path SH2, a sheet output path SH3, a sheet reversing path SH4, and a sheet circulation path SH6. The image recording unit U3*a* records an image on the recording sheet S, which has been transported from the medium feeding device U2, on the basis of a document image read by the image reading device U1. The image forming apparatus body U3 also includes a controller C, a latent image forming device driving circuit D that is controlled by the controller C, and a power supply circuit E. The latent image forming device driving circuit D outputs driving signals to latent image forming devices ROSy, ROSm, ROSc, and ROSk for respective colors Y to K on the basis of image information, which has been input from the image reading device U1, at a preset timing.

A visible image forming device drawer U3*c*, which is an example of a drawer member, is disposed below the latent image forming devices ROSy, ROSm, ROSc, and ROSk for respective colors the Y to K. The visible image forming device drawer U3*c* is supported by slide rails R1, which are examples of a pair of left and right guide members, so as to be movable between a pulled-out position and a mount position. The pulled-out position is a position in which the visible image forming device drawer U3*c* is pulled out to the front of the image forming apparatus body U3, and the mount position is a position in which the visible image forming device drawer U3*c* is mounted in the image forming apparatus body U3.

Referring to FIGS. 1 and 2, the photoconductor unit UK for color K, which is an example of an image holding unit, includes a photoconductor drum Pk, a charging roller CRk, and a cleaner CLk. The photoconductor drum Pk is an example of an image holder on which an electrostatic latent image and a toner image are formed. The charging roller CRk is an example of a charger. The cleaner CLk is an example of an image holder cleaner. Likewise, the photoconductor units UY, UM, and UC for the colors Y, M, and C includes photoconductor drums Py, Pm, and Pc, charging rollers CRy, CRm, and CRc, and cleaners CLy, CLm, and CLc, respectively. A visible image forming device UK+Gk for color K is constituted by the photoconductor unit UK and a developing device Gk. The developing device Gk, which is an example of a developer holder, includes a development roller R0*k*. Likewise, visible image forming devices UY+Gy, UM+Gm, and UC+Gc for colors Y, M, and C are constituted by photoconductor units UY, UM, and UC and developing devices Gy, Gm, and Gc including development rollers ROy, ROm, and R0*c*, respectively. The visible image forming device drawer U3*c* includes a drawer body U3*c*1, which is an example of a holding body. The photoconductor units UY, UM, UC, and UK the developing devices Gy, Gm, Gc, and Gk are removably attached to the visible image forming device drawer U3*c*.

Referring to FIG. 1, the charging rollers CRy, CRm, CRc, and CRk uniformly charge the surfaces of the photoconductor drums Py, Pm, Pc, and Pk, respectively, while the photoconductor drums are rotating. Then, the latent image forming devices ROSy, ROSm, ROSc, and ROSk emit laser beams Ly, Lm, Lc, and Lk, which are examples of latent image writing light, toward the surfaces of the photoconductor drums Py, Pm, Pc, and Pk, which are rotating, so that electrostatic latent images are formed on the surfaces. The developing devices Gy, Gm, Gc, and Gk develop the electrostatic latent images on the surfaces of photoconductor drums Py, Pm, Pc, and Pk to form toner images in yellow Y, magenta M, cyan C, and black K, which are examples of visible images.

When developer is consumed by the developing devices Gy to Gk for developing, new developer is supplied from toner cartridges Ky, Km, Kc, and Kk that are removably attached to the developer supplying device U3*b*. The toner cartridges are examples of a developer container. In the first exemplary embodiment, two-component developer composed of toner and carrier is used as the developer. The toner cartridges Ky, Km, Kc, and Kk supply concentrated developer that has a higher toner concentration than the developer contained in the developing devices Gy to Gk. Therefore, in the first exemplary embodiment, concentrated developer, which includes a small amount of carrier, is supplied to the developing devices Gy to Gk while gradually discharging developer including deteriorated carrier from the developing devices Gy to Gk, whereby the carrier is replaced. Such a technology of gradually replacing the carrier has been described, for example, in Japanese Unexamined Patent Application Publication No. 2000-81787 and Japanese Unexamined Patent Application Publication No. 2003-84570. Therefore, detailed description of the technology will be omitted.

Developer including deteriorated carrier is discharged to back end portions of the developing devices Gy to Gk from deteriorated developer discharging portions G1*y* to G1*k*. At the same time, the toner cartridges Ky to Kk supply new developer including new carrier to the developing devices Gy to Gk, so that the developer in the developing devices Gy to Gk is gradually replaced with the new developer. The developer that has been discharged from the deteriorated developer discharge portions G1*y* to G1*k* flows into deteriorated developer transport paths G2*y* to G2*k*, which extend backward. The developer is transported backward by deteriorated developer transport members G3*y* to G3*k*, which are disposed in the deteriorated developer transport paths G2*y* to G2*k*, and recovered in deteriorated developer recovery portions (not shown).

The toner images on the surfaces of the photoconductor drums Py, Pm, Pc, and Pk are successively transferred by first transfer rollers T1*y*, T1*m*, T1*c*, and T1*k* onto intermediate transfer belt B in first transfer regions Q3*y*, Q3*m*, Q3*c*, and Q3*k* in an overlapping manner, so that a color toner image is formed on the intermediate transfer belt B. The first transfer rollers are examples of a first transfer unit, the intermediate transfer belt B is an example of an intermediate transfer body, and the color toner image is an example of a multicolor visible image. The color toner image formed on the intermediate transfer belt B is transported to a second transfer region Q4. When the image information is only for color K, only the photoconductor drum Pk and the developing device Gk are used, and a toner image in color K is formed. After the first transfer has been finished, residual materials such as residual developer and paper dust adhering to the surfaces of the photoconductor drums Py, Pm, Pc, and Pk are removed by the cleaners CLy, CLm, CLc, and CLk.

An intermediate transfer device drawer U3*d*, which is an example of a drawer member, is disposed below the visible image forming device drawer U3*c* so as to be movable between a pulled-out position and a mount position. The pulled-out position is a position in which the intermediate transfer device drawer U3*d* is pulled out to the front of the image forming apparatus body U3, and the mount position is a position in which the intermediate transfer device drawer U3*d* is mounted in the image forming apparatus body U3. The intermediate transfer device drawer U3*d* supports a belt module BM, which is an example of an intermediate transfer device, so that the belt module BM is movable up and down between an upper position in which the belt module BM contacts the lower surfaces of the photoconductor drums Py, Pm, Pc, and Pk and a lower position in which the belt module BM is separated from these lower surfaces. The belt module BM includes the intermediate transfer belt B, a belt supporting roller Rd+Rt+Rw+Rf+T2*a*, and the first transfer rollers T1*y*, T1*m*, T1*c*, and T1*k*. The belt supporting roller Rd+Rt+Rw+Rf+T2*a*, which is an example of an intermediate transfer body drive member, is constituted by a drive roller Rd, a tension roller Rt, a walking roller Rw, plural idler rollers Rf, and a backup roller T2. The drive roller Rd is an example of an intermediate transfer body drive member, the tension roller Rt is an example of a tension generating member, the walking roller Rw is an example of a meandering prevention member, the idler rollers Rf are examples of a driven member, and the backup roller T2 is an example of a second transfer facing member. The intermediate transfer belt B is supported by the belt supporting roller Rd+Rt+Rw+Rf+T2*a* so as to be rotatable in the direction of arrow Y.

A second transfer unit Ut is disposed below the backup roller T2*a*. The second transfer unit Ut includes a second transfer roller T2*b*, which is an example of a second transfer member. The second transfer roller T2*b* may be in contact with or separated from the backup roller T2*a* with the intermediate transfer belt B therebetween. The second transfer region Q4 is a region in which the second transfer roller T2*b* is pressed against the intermediate transfer belt B. A contact roller T2*c*, which is an example of a contact electricity feed member, is in contact with the backup roller T2*a*. The power supply circuit E, which is controlled by the controller C, applies a second transfer voltage to the contact roller T2*c* at a preset timing. A second transfer unit T2 is constituted by the backup roller T2*a*, the second transfer roller T2*b*, and the contact roller T2*c*.

A sheet transport path SH2 is disposed below the belt module BM. The recording sheet S, which has been fed through the medium feeding path SH1 of the medium feeding device U2, is transported by medium transport rollers Ra to registration rollers Rr in the sheet transport path SH2. The medium transport rollers Ra are examples of a recording medium transport member, and the registration rollers Rr are examples of a transport timing adjusting member. The registration rollers Rr transport the recording sheet S downstream at the same time as a toner image formed on the intermediate transfer belt B is transported to the second transfer region Q4. The recording sheet S is guided by a registration-side sheet guide SGr and a pre-transfer sheet guide SG1, and transported to the second transfer region Q4. The registration-side sheet guide SGr and the registration rollers Rr are fixed to the image forming apparatus body U3. The toner image on the intermediate transfer belt B is transferred to the recording sheet S by the second transfer unit T2 when the toner image passes the second transfer region Q4. When forming a color toner image, toner images that have been successively first-transferred onto the intermediate transfer belt B in an overlapping manner are simultaneously second-transferred to the recording sheet S. A transfer device T1*y* to T1*k*+T2+B according to the first exemplary embodiment is constituted by the first transfer rollers T1*y* to T1*k*, the second transfer unit T2, and the intermediate transfer belt B.

After the second transfer has been finished, the intermediate transfer belt B is cleaned by a belt cleaner CLB, which is disposed below a right-side portion of the intermediate transfer belt B. The belt cleaner CLB is an example of an intermediate transfer body cleaner. The belt cleaner CLB removes residual materials on the intermediate transfer belt B, such as developer that was not used in the second transfer and paper dust, from the intermediate transfer belt B. Referring to FIG. 2, the residual materials that have been removed from the intermediate transfer belt B flow into a belt-cleaner-remaining-object transport path CLB1, which is disposed below the belt cleaner CLB and extends backward. The residual materials are transported to the back side of the image forming apparatus body U3 by the belt-cleaner-remaining-object transport member CLB2 disposed in the belt-cleaner-remaining-object transport path CLB1, and recovered in the deteriorated developer recovery portion (not shown). The second transfer roller T2*b* and the belt cleaner CLB are disposed so as to be in contact with or separated from the intermediate transfer belt B.

The recording sheet S, on which the toner image has been second-transferred, is transported to a fixing region Q5 of a fixing device F via a post-transfer sheet guide SG2 and a medium transport belt BH, which is an example of a transport member. The fixing region Q5 is a region in which a pressure roller Fp, which is an example of a pressure fixing member, is pressed against a fixing roller Fh. When the toner image formed on the recording sheet S passes the fixing region Q5, the toner image is heat-fixed by the fixing device F. The image recording unit U3*a* according to the first exemplary embodiment is constituted by the visible image forming devices UY+Gy to UK+Gk, the transfer devices T1*y* to T1*k*+T2+B, and the fixing device F. A switching gate GT1, which is an example of a switching member, is disposed downstream of the fixing device F. The switching gate GT1 switches the path of the sheet S, which has been transported through the sheet transport path SH2 and heat-fixed in the fixing region Q5, between the sheet output path SH3 and the sheet reversing path SH4 in accordance with selection by a user. The sheet output path SH3 and the sheet reversing path SH4 are near the medium handling device U4. The recording sheet S that has been transported to the sheet output path SH3 is transported to a sheet transport path SH5 of the medium handling device U4. A curl correction member U4*a*, which is an example of a media-warping correction member, is disposed in the sheet transport path SH5. The curl correction member U4*a* corrects a curl, which is warping of the recording sheet S. Then, the recording sheet S is output by output rollers Rh to an output tray TH1 with an image-fixed surface facing up. The output rollers Rh are examples of a medium output member, and the output tray TH1 is an example of a medium output section of the medium handling device U4.

The recording sheet S that has been transported by the switching gate GT1 to the sheet reversing path SH4 of the image forming apparatus body U3 passes through a Mylar gate GT2, which is an example of a flexible switching member, and transported to a sheet reversing path SH4 of the image forming apparatus body U3. At this time, when outputting the recording sheet S with the image-fixed surface facing down, the recording sheet S is reversed right after the trailing end of the recording sheet S in the transport direction has passed the Mylar gate GT2. In this case, the Mylar gate GT2 temporarily passes the recording sheet S that has been transported to the sheet reversing path SH4, and when the sheet S is transported back to the Mylar gate GT2, the Mylar gate GT2 transports the sheet S toward the sheet transport paths SH3 and SH5. Then, the recording sheet S is output to an output tray TH1 with the image-fixed surface facing down.

A sheet circulation path SH6 is connected to a middle portion of the sheet reversing path SH4 of the image forming apparatus body U3, and a Mylar gate GT3 is disposed at the connection portion. The downstream end of the sheet reversing path SH4 of the image forming apparatus body U3 is connected to the sheet reversing path SH7 of the medium handling device U4. The recording sheet S that has passed through the switching gate GT1 to the sheet transport path SH4 is transported by the Mylar gate GT3 toward the sheet reversing path SH7 of the medium handling device U4. The Mylar gate GT3 temporarily passes the recording sheet S that has been transported through the sheet reversing path SH4, and when the sheet S is transported back to the Mylar gate GT3, the Mylar gate GT3 transports the sheet S toward the sheet circulation path SH6. The recording sheet S, which has been transported to the sheet circulation path SH6, passes through the medium feed path SH1 and transported again to the transfer region Q4, subjected to duplex printing, transported to the medium handling device U4, and output to the output tray TH1. The sheet transport path SH is constituted by the members SH1 to SH7. The sheet transport device SU is constituted by the members SH, Ra, Rr, Rh, SGr, SG1, SG2, BH, and GT1 to GT3.

Description of Automatic Document Transport Device U1*a*

Referring to FIG. 3, a document transport apparatus body U1*a*2 is disposed on the left side of the automatic document transport device U1*a*. A document transport path GH, along which the document Gi is transported, is formed in the document transport apparatus body U1*a*2. The document transport path GH includes a first document transport path GH1, a second document transport path GH2, and a third document transport path GH3. The first document transport path GH1 extends leftward from an upper right portion of the document transport apparatus body U1*a*2. The second document transport path GH2 extends archwise from the left end of the first document transport path GH1 toward the image reading position X1 on the transported-document reading surface PG1. The third document transport path GH3 extends from the image reading position X1 to a lower right portion of the document transport apparatus body U1*a*2.

Figure 4A:
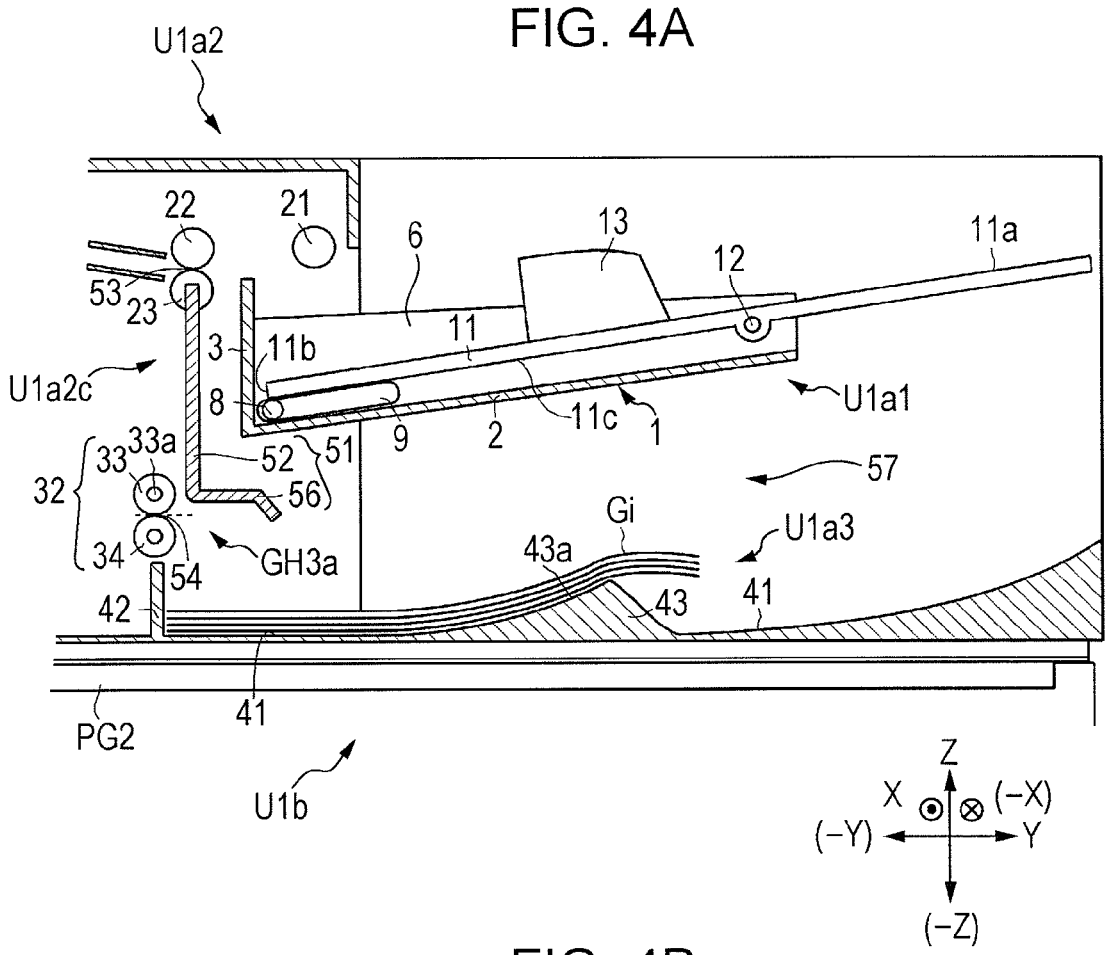
Figure 4B:
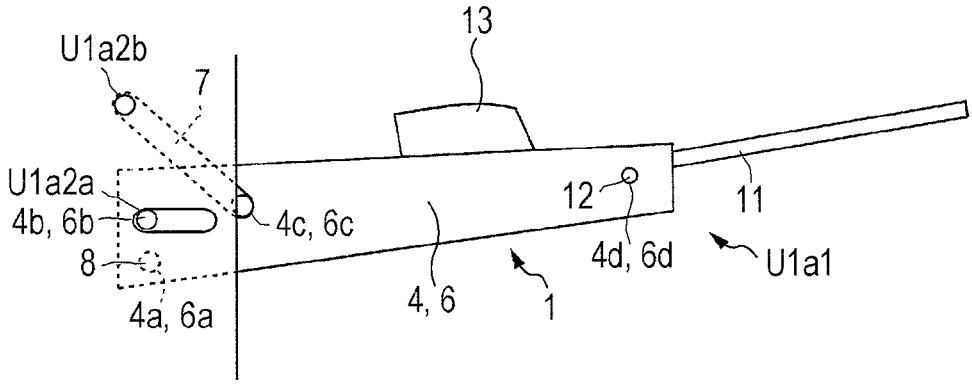
Figure 5A:
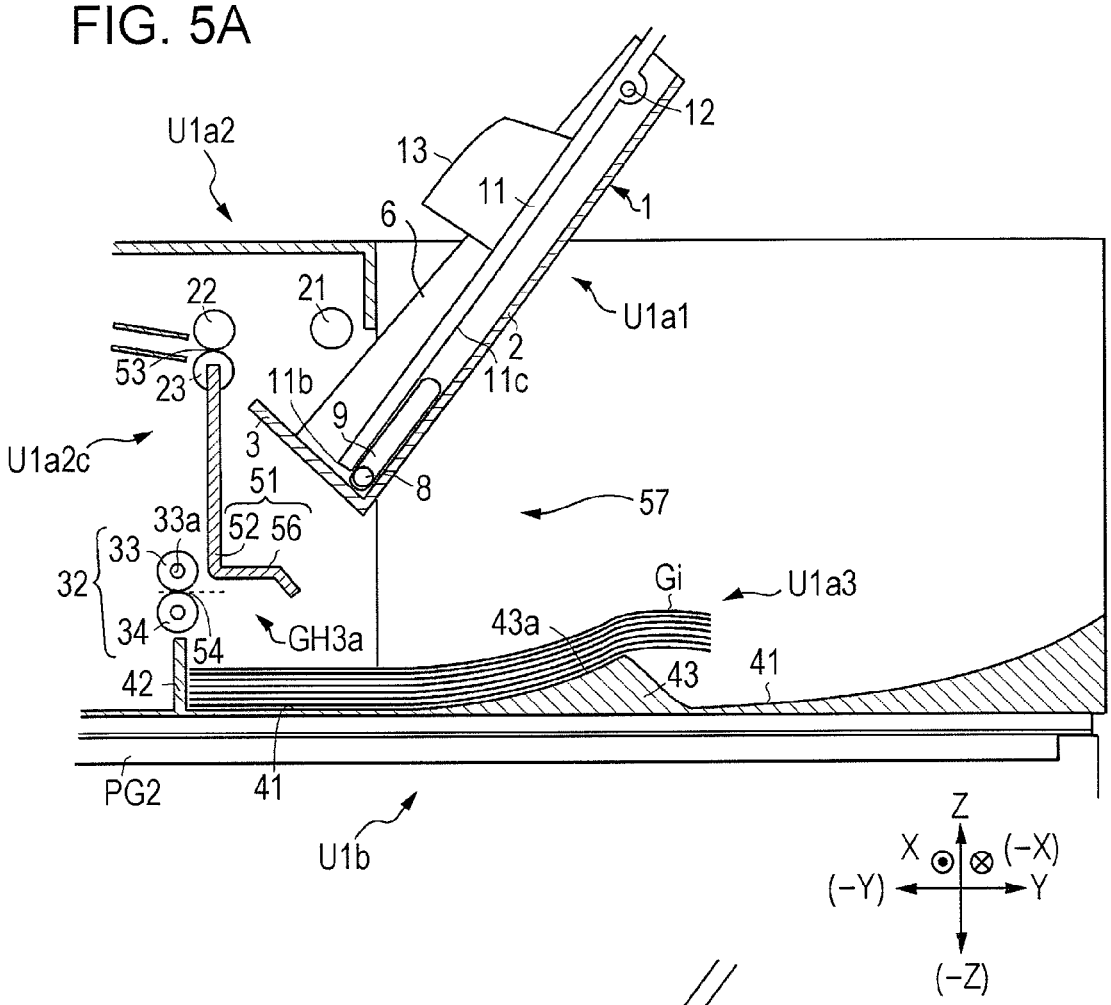
Figure 5B:
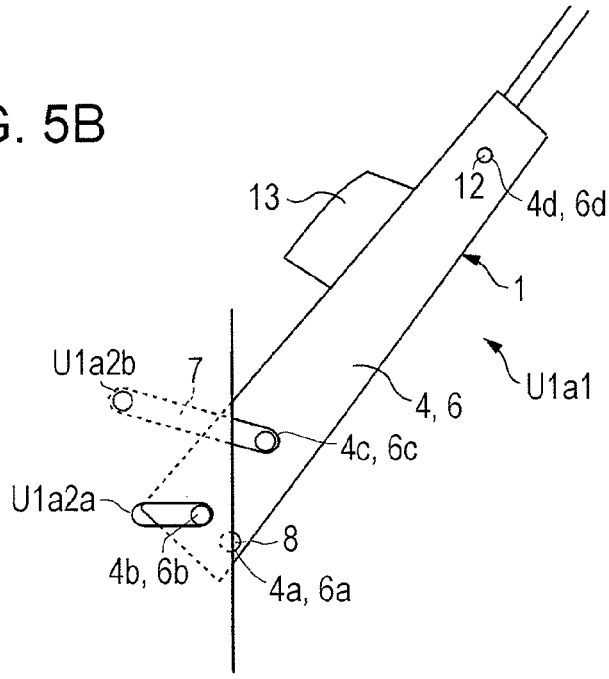

FIGS. 4A and 4B illustrate a document feed tray that is held in a stacking position, in which FIG. 4A illustrates the document feed tray and FIG. 4B illustrates a supporting member of the document feed tray viewed from the front side. FIGS. 5A and 5B illustrate the document feed tray that is held in an open position, in which FIG. 5A illustrates the document feed tray and FIG. 5B illustrates the supporting member of the document feed tray viewed from the front side. Referring to FIGS. 3 to 5B, the document feed tray U1*a*1 is supported by the document transport apparatus body U1*a*2 on the right side of the right end portion of the first document transport path GH1. The document feed tray U1*a*1 includes a tray body 1, which is an example of a container body. Referring to FIGS. 3 to 4B, the tray body 1 includes a plate-shaped bottom portion 2 that extends in the left-right direction. A document-end aligning portion 3, which is an example of a left wall, stands up on the left end of the bottom portion 2. A front wall 4 and a back wall 6 stand up on the front and back ends of the bottom portion 2.

Referring to FIG. 4B, a link shaft supporting hole 4*a* extends through a lower left portion of the front wall 4 in the front-back direction. The link shaft supporting hole 4*a* is an example of a supporting portion for an elevation force transmitting member. A guided shaft 4*b*, which protrudes frontward, is formed above the link shaft supporting hole 4*a*. The guided shaft 4*b* is an example of a guided member. On the right side of the guided shaft 4*b*, an arm supporting hole 4*c*, which is an example of an arm member supporting portion, is formed. In a right end portion of the front wall 4, a plate supporting hole 4*d*, which is an example of a support portion for a stacker body, is formed. In the back wall 6, as in the front wall 4, a link shaft supporting hole 6*a*, a guided shaft 6*b*, an arm supporting hole 6*c*, and a plate supporting hole 6*d* are formed. The link shaft supporting hole 6*a*, the guided shaft 6*b*, the arm supporting hole 6*c*, and the plate supporting hole 6*d* in the back wall 6 are the same as the link shaft supporting hole 4*a*, the guided shaft 4*b*, the arm supporting hole 4*c*, and the plate supporting hole 4*d* in the front wall 4, except that the corresponding members are symmetrical with respect to the front-back direction. Therefore, detailed description of these members will be omitted.

Referring to FIGS. 4B and 5B, the guided shafts 4*b* and 6*b* in the front wall 4 and the back wall 6 are supported so as to be movable in the left-right direction along slots U1*a*2*a* formed in the front wall 4 and the back wall 6 of the document transport apparatus body U1*a*2, respectively. On end of a support arm 7, which is an example of an arm member, is attached to a support portion U1*a*2*b* formed on the document transport apparatus body U1*a*2. The other end of the support arm 7 is rotatably supported in the arm supporting holes 4*c* and 6*c* in the front wall 4 and the back wall 6. Thus, the tray body 1 is supported so that the tray body 1 may be tilted with respect to the document transport apparatus body U1*a*2 while the document-end aligning portion 3 is moved rightward. That is, the tray body 1 of the first exemplary embodiment is supported so as to be movable between a stacking position illustrated in FIG. 4 and a take-out position illustrated in FIG. 5. The stacking position, which is an example of an open position, is a position in which the document Gi may be stacked on the tray body 1. The take-out position, which is an example of an open position, is a position in which a space below the tray body 1 with respect to the direction of gravity is open and the document on the sheet output tray U1*c* may be taken out.

Figure 6A:
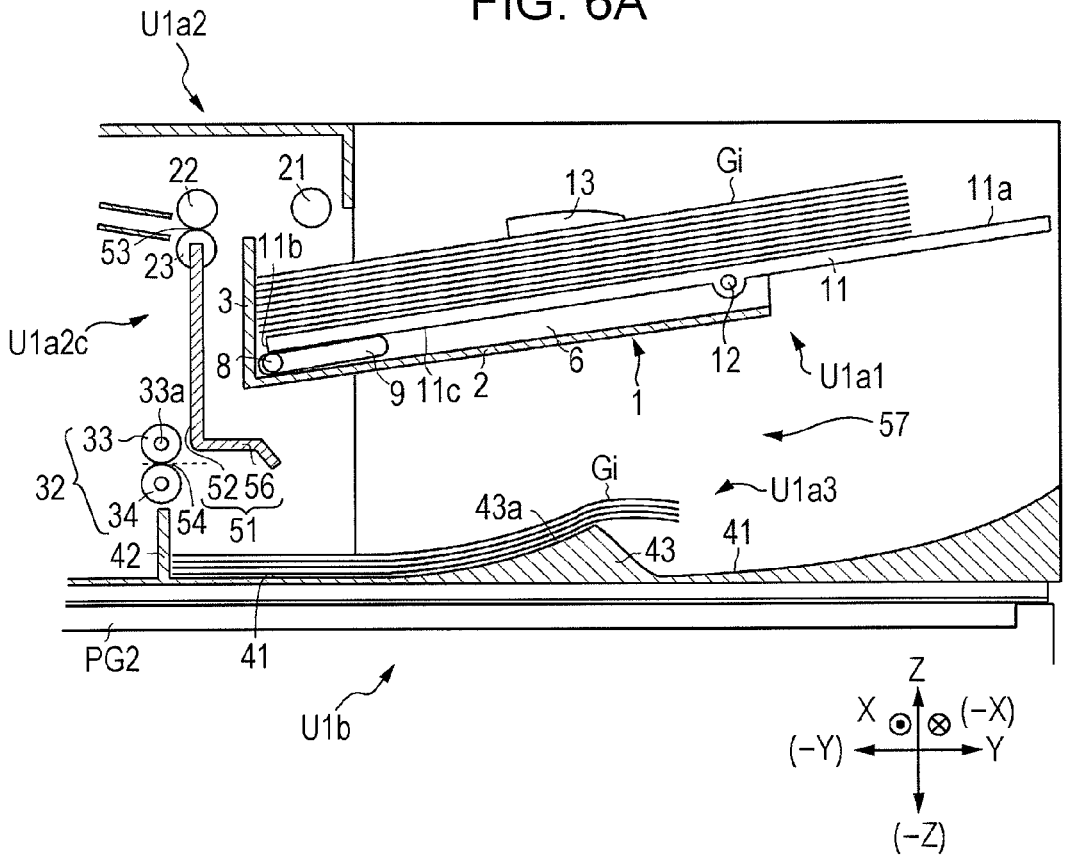
Figure 6B:
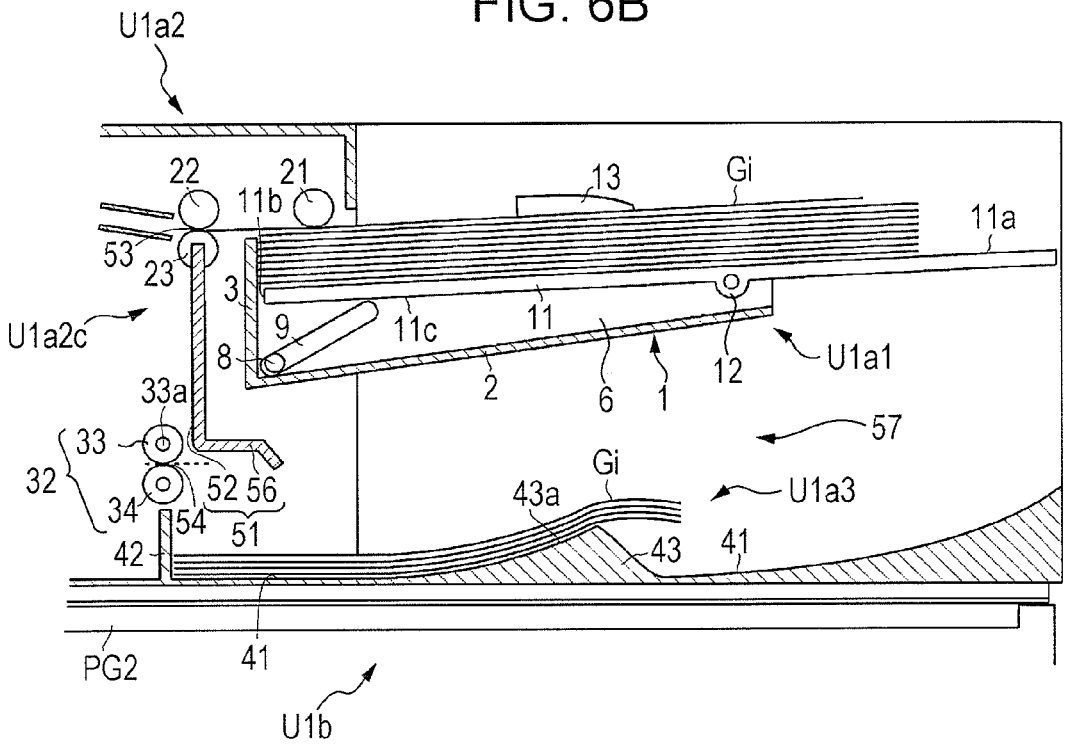

FIGS. 6A and 6B illustrate an elevation plate, in which FIG. 6A illustrates the elevation plate when documents are placed thereon and FIG. 6B illustrates the elevation plate when a document is being fed to a body of a document transport device. Referring to FIGS. 4 to 6, a link shaft 8, which extends in the front-back direction, is rotatably supported in the link shaft supporting holes 4*a* and 6*a* formed in the front wall 4 and the back wall 6. The link shaft 8 is an example of an elevation force transmission member. The link shaft 8 protrudes backward from the back wall 6 and supported. A driven gear (not shown), which is an example of a driven member, is supported at the back end of the link shaft 8. The driven gear meshes with a drive gear (not shown), which is an example of a drive member, disposed in the document transport apparatus body U1*a*2. Forward and backward rotations are transmitted to the drive gear from a drive source (not shown), and the link shaft 8 is rotated forward and backward by the driven gear. In first exemplary embodiment, the driven gear of the link shaft 8 may be in contact with or separated from the drive gear of the document transport apparatus body U1*a*2. The driven gear moves between the stacking position and the take-out position together with the tray body 1. That is, when the tray body 1 is held in the stacking position, the driven gear and the drive gear mesh with each other. When the tray body 1 is held in the take-out position, the driven gear and the drive gear do not mesh with each other. Such a mechanism including the driven gear and the drive gear is known, and detailed description of the structure will be omitted.

A plate push-up portion 9, which extends rightward, is supported on the link shaft 8 between the front wall 4 and the back wall 6. The plate push-up portion 9 is an example of a stacker body push-up member. Therefore, when the link shaft 8 rotates forward and backward, the plate push-up portion 9 moves between a flat position illustrated in FIG. 6A and an erect position illustrated in FIG. 6B. In the flat position, the plate push-up portion 9 extends along the bottom portion 2. In the erect position, the plate push-up portion 9 is raised with respect to the bottom portion 2. Referring to FIGS. 4 to 6, an elevation plate 11 is rotatably supported by a support shaft 12 in the plate supporting holes 4*d* and 6*d* in the front wall 4 and the back wall 6. The elevation plate 11, which is an example of a stacker body, has an upper surface 11*a* for stacking the documents Gi thereon. A left end portion 11*b* of the elevation plate 11 extends toward the document-end aligning portion 3. The elevation plate 11 has a length that allows a lower surface 11*c* thereof to be normally in contact with the plate push-up portion 9. A side guide 13 is supported on the elevation plate 11 so as to be movable in the front-back direction. The side guide an example of a member for aligning ends of the documents in the width direction.

When the plate push-up portion 9 rotates from the flat position toward the erect position, the elevation plate 11 is pushed up by the plate push-up portion 9 and rotated around the support shaft 12, so that the left end portion 11*b* of the elevation plate 11 is raised. That is, the elevation plate 11 moves between a document set position illustrated in FIG. 6A and a document feed position illustrated in FIG. 6B in accordance of the movement of the plate push-up portion 9 between the flat position and the erect position. When the elevation plate 11 is in the document set position, which is an example of a standby position, the document Gi is stacked on the elevation plate 11. When the elevation plate 11 is in the document feed position, which is an example of a feed position, the document Gi is fed to the document transport apparatus body U1*a*. The amount by which the elevation plate 11 is raised, i.e., the rotation angle of the link shaft 8 to push up the elevation plate 11, is adjusted in accordance with the position of the uppermost position of the documents Gi, which is detected by a document detection member (not shown). The document feed tray U1*a*1 of the first exemplary embodiment is constituted by the members denoted by the numerals 1 to 13. The document feed tray U1*a*1 of first exemplary embodiment has a known structure.

Referring to FIG. 3, in the document transport apparatus body U1*a*2, a document pickup roller 21 is supported at the upstream end of the first document transport path GH1 with respect to the document transport direction. The document pickup roller 21, which is an example of a document pickup member, picks up the document Gi from the elevation plate 11 in the document feed position. A document feed roller 22 is supported at a position downstream of the document pickup roller 21 with respect to the document transport direction and above the first document transport path GH1 with respect to the direction of gravity. The document feed roller 22 is and example of an upper feed member and a document feed member. A retard roller 23 is supported at a position below the document feed roller 22 and the first document transport path GH1 with respect to the direction of gravity so as to face the document feed roller 22. The retard roller 23 is an example of a lower feed member and a document stopping member. When plural documents Gi are picked up by pickup roller 21, the document feed roller 22 transports the uppermost one of the documents Gi while the document retard roller 23 stops the other documents Gi, so that the document feed roller 22 and the document retard roller 23 separate and transport the documents Gi one by one. A document separation portion 22+23 of the first exemplary embodiment is constituted by the document feed roller 22 and the document retard roller 23.

A document feed member 21+22+23 of the first exemplary embodiment is constituted by the document pickup roller 21, the document feed roller 22, and the document retard roller 23. That is, the document feed member 21+22+23 feeds the document Gi stacked on the document feed tray U1*a*1 toward the image reading position X1. Document transport rollers 24, which are examples of a first document transport member, are supported at a position downstream of the document feed member 21+22+23 with respect to the document transport direction. The document transport rollers 24 transport the document Gi toward the second document transport path GH2. Pre-registration rollers 26, which are examples of a second document transport member, are supported at the upstream end of the second document transport path GH2 with respect to the document transport direction. Document registration rollers 27 are supported at a position in a downstream portion of the second document transport path GH2 with respect to the document transport direction. The document registration rollers 27, which are examples of a document transport timing adjusting member, adjust the timing at which the document Gi is transported toward the image reading position X1.

A platen roller 28, which is an example of a reading assisting member, is supported at the downstream end of the second document transport path GH2. The platen roller 28 is disposed so as to face the transported-document reading surface PG1, and transports the document Gi while pressing the document Gi against the transported-document reading surface PG1. An image reading sensor 29, which is an example of a second image reading unit, is supported at a position downstream of the platen roller 28 with respect to the document transport direction. The image reading sensor 29 is disposed so as to face the transported-document guide portion PG3, and reads a document image on the second surface of the document Gi. The image reading sensor 29 of first exemplary embodiment includes a contact image sensor (CIS). Thus, in the first exemplary embodiment, a document image recorded on the first surface of the document Gi is read at the image reading position X1 by the flatbed image reading unit U1*b*. When a document image is recorded on the second surface of the document Gi, the document image on the second surface is read at the second image reading position X2 by the image reading sensor 29. An image reading unit U1*b*+29 of the first exemplary embodiment is constituted by the flatbed image reading unit U1*b* and the image reading sensor 29.

An out roller 31, which is an example of a third document transport member, is disposed at a position downstream of the image reading sensor 29 with respect to the document transport direction. A document output roller 32 is supported at a position downstream of the out roller 31 with respect to the document transport direction. The document output roller 32, which is an example of a document output member, outputs the document Gi whose document image has been read to the document output tray U1*a*3. The document output roller 32 includes a document output drive roller 33 and a document output driven roller 34. The document output drive roller 33, which is an example of an upper output member and an example of a document output drive member, is disposed above the third document transport path GH3 with respect to the direction of gravity. The document output driven roller 34, which is an example of a lower output member and an example of document output driven member, is disposed below the third document transport path GH3 with respect to the direction of gravity so as to face the document output drive roller 33. In the first exemplary embodiment, the document output roller 32 is disposed on the left side of the document feed member 21+22+23.

A document output tray U1*a*3 is disposed at a position downstream of the third document transport path GH3 with respect to the document transport direction and above the document feed tray U1*a*1 with respect to the direction of gravity. The document output tray U1*a*3 has a document stacking surface 41 on which the document Gi that has been output is stacked. An upright wall 42 stands up at the left end of the document stacking surface 41. The upper end of the upright wall 42 extends to the document output driven roller 34. A document take-out assist portion 43 is disposed in the middle of the document stacking surface 41 in the left-right direction. The document take-out assist portion 43, which is an example of an output document support portion, supports the document Gi that has been output. The document take-out assist portion 43 has an inclined surface 43*a* that is inclined upward with respect to the document stacking surface 41. Therefore, when the document Gi is output to the document output tray U1*a*3 and supported by the inclined surface 43*a* of the document take-out assist portion 43, a gap is generated between the document stacking surface 41 and the lower surface of the document Gi, whereby a user may easily take out the document G1 from below.

Figure 7:
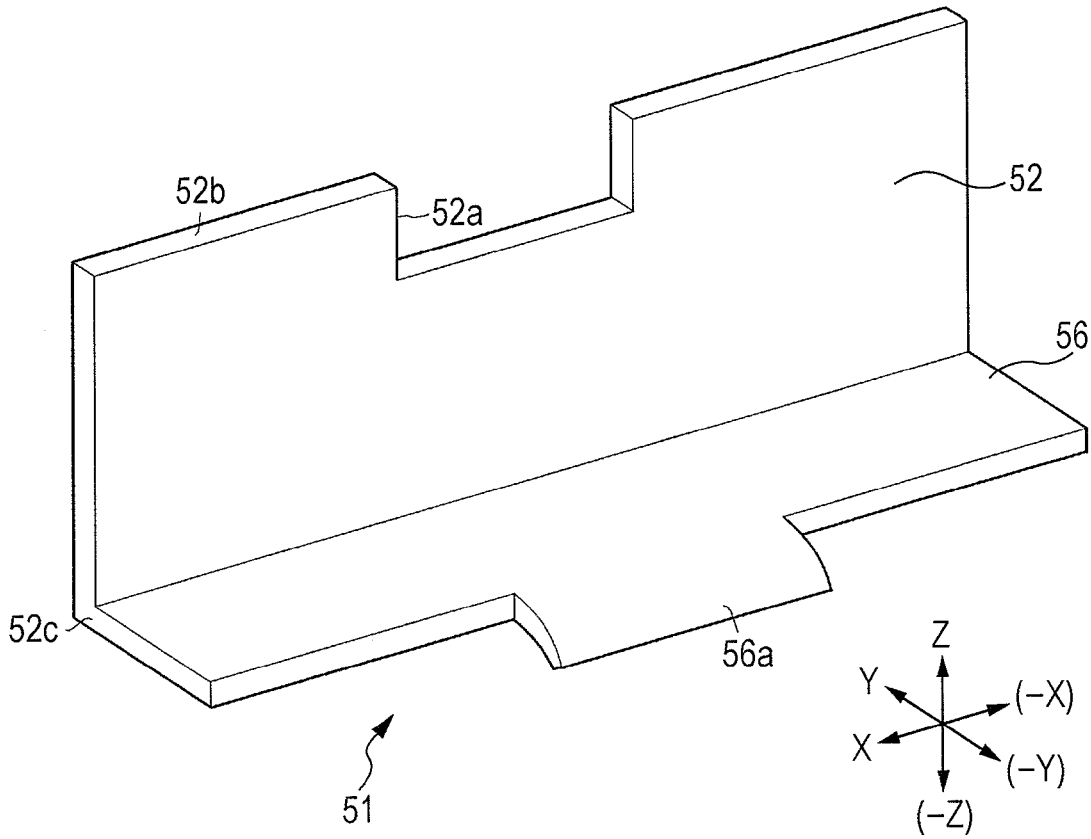
FIG. 7 is an overall perspective view of a shielding member according to the first exemplary embodiment of the present invention.

FIG. 7 is an overall perspective view of a shielding member according to the first exemplary embodiment of the present invention. Referring to FIGS. 3 to 7, a protection member 51 is supported at a position above, with respect to the direction of gravity, a document output slot GH3*a* at the downstream end of the third document transport path GH3 with respect to the document transport direction. The protection member 51, which is an example of shielding member, is disposed between the document output roller 32 and the document output tray U1*a*3 with respect to the document transport direction. Referring to FIG. 7, the protection member 51 has a vertical plate portion 52, which is an example of a first shielding portion and extends in the vertical direction and in the width direction of the document. A retard roller containing recess 52*a* is formed above the vertical plate portion 52 with respect to the direction of gravity. The retard roller containing recess 52*a*, which is an example of a feed member container, has a recessed shape that corresponds to the shape of the retard roller 23.

The vertical plate portion 52 and the retard roller 23 are supported by a frame U1*a*2*c* of the document transport apparatus body U1*a*2, which is an example of a frame body. The retard roller 23 is contained in the retard roller containing recess 52*a*. As illustrated in FIG. 3, an upper end 52*b* of the vertical plate portion 52 with respect to the direction of gravity is disposed below a separation region 53, which is a region in which the feed roller 22 and the retard roller 23 contact each other. As illustrated in FIG. 3, the vertical plate portion 52 is disposed at a position corresponding to the retard roller 22. A lower end 52*c* of the vertical plate portion 52 with respect to the direction of gravity is disposed above an output region 54, which is a region in which the document output drive roller 33 and the document output driven roller 34 contact each other. In particular, in the first exemplary embodiment, as illustrated in FIG. 3, the lower end 52*c* of the vertical plate portion 52 with respect to the direction of gravity is disposed below a rotation shaft 33*a* of the document output drive roller 33.

Referring to FIG. 7, a horizontal plate portion 56 is supported at the lower end 52*c* of the vertical plate portion 52 with respect to the direction of gravity. The horizontal plate portion 56, which is an example of a second shielding portion, extends from the lower end 52*c* of the vertical plate portion 52 with respect to the direction of gravity in a downstream direction with respect to the document transport direction, i.e. to the right. In first exemplary embodiment, the horizontal plate portion 56 extends to a position below the left end of the document feed tray Ulal in the stacking position. A document guide portion 56*a* is formed at the right end of the horizontal plate portion 56. The document guide portion 56*a*, which is an example of a document guide portion, extend to the right and downward toward the document output tray U1*a*3. The document guide portion 56*a* guides the document Gi, which has been output through the document output slot GH3*a*, to the document output tray U1*a*. The protection member 51 of the first exemplary embodiment is constituted by the vertical plate portion 52 and the horizontal plate portion 56.

Function of First Exemplary Embodiment

With the copier U according to the first exemplary embodiment having the structure described above, when copying is started, if the document Gi is placed on the placed-document reading surface PG2, a manual reading operation of reading a document image on the document Gi is started, and if the document Gi is stacked on the elevation plate 11, an automatic reading operation of reading the document Gi that is transported is started. When the automatic reading operation is started, the elevation plate 11 is raised while the tray body 1 is in the stacking position. That is, the elevation plate 11, on which the documents Gi is stacked, is raised from the document set position toward the pickup roller 21, and moved to the document feed position in which the document Gi, which is stacked on the elevation plate 11, contacts the pickup roller 21. Then, the pickup roller 21 is rotated, and the document Gi on the document feed tray U1*a*1 is fed into the document transport apparatus body U1*a*2 by the document feed member 21+22+23.

The document Gi, which has been fed into the document transport apparatus body U1*a*2, is transported along the document transport path GH, and the document image recorded on the document Gi is read at the image reading positions X1 and X2. Then, the document Gi, which has passed the image reading positions X1 and X2, is output to the document output tray U1*a*3 by the document output roller 32, and stacked on the document stacking surface 41 of the document output tray U1*a*3. When a user takes out the document Gi, whose document image has been read, the document feed tray U1*a*1, which is above the document output tray U1*a*3, is rotated from the stacking position to the take-out position, so that a space 57 between the document feed tray U1*a*1 and the document output tray U1*a*3 is opened. As compared with the case where the space 57 is not opened, a user may easily insert his/her hand into the space 57, and document Gi is easily taken out from the document output tray U1*a*3. At this time, with the automatic document transport device U1*a* according to the first exemplary embodiment, the document output drive roller 33 is shielded from the space 57 by the protection member 51, so that, when the space 57 is opened, the document output drive roller 33 is not exposed to the outside, in particular, in an upward direction from which a user inserts his/her hand.

With an existing structure that does not include the protection member 51, when the space 57 is opened, the document output slot PG3*a* is exposed to the outside, and the document output drive roller 33 is exposed to the outside. Therefore, if a user directly inserts his/her hand into the space 57 when, for example, the user tries to pick up a writing instrument or the like that has been dropped or to remove dust, or if the writing instrument or the like rolls down over the elevation plate 11 of the document feed tray U1*a*1, such foreign substances may contact an exposed portion of the document output drive roller 33 and the document output drive roller 33 or the inside of the document transport path GH may be smudged, so that document transportation performance may be impaired or the document G1 may be damaged. Moreover, for example, when a user takes out the document Gi that that has been stacked while other documents Gi are being transported, his/her hand may contact the document output drive roller 33.

In particular, when a large number of documents Gi are to be stacked on the document feed tray U1*a*1 using the elevation plate 11 as in the first exemplary embodiment, in order to allow a large number of sheets to be stacked on the sheet feed tray U1*a*, the height (i.e., the length) of the document-end aligning portion 3 is increased and the distance between the document feed member 21+22+23 and the document output drive roller 33 is increased. Therefore, when the document feed tray U1*a*1 is rotated upward, the space 57 is opened widely, and the document output slot GH3*a* and the document output drive roller 33 are more widely exposed. As a result, foreign substances may easily contact the document output drive roller 33.

In contrast, in the automatic document transport device U1*a* according to the first exemplary embodiment, the protection member 51 is supported at a position between the document output roller 32 and the document output tray U1*a*3, so that the document output drive roller 33 and the document output slot GH3*a* are shielded from the space 57 and are not widely exposed to the outside. Therefore, with the first exemplary embodiment, even if foreign substances enter the space 57, the document output drive roller 33 and the document transport path GH are shielded and protected by the protection member 51 and thereby not easily smudged. In particular, the protection member 51 of the first exemplary embodiment is disposed on the document output tray U1*a*3 side with respect to the document output roller 32, and the protection member 51 includes the horizontal plate portion 56 extending toward the document output tray U1*a*3. Therefore, when the space 57 is opened and a user's hand or foreign substances enter the space 57 from the upper right side, the horizontal plate portion 56 shields the entry of the foreign substances or the like, and document output drive roller 33 is protected. If the user inserts his/her hand from the document output tray U1*a*3 side toward the document output roller 32, the user's hand may easily contact the horizontal plate portion 56 of the protection member 51 before contacting the document output drive roller 33. That is, because the user's hand contacts the protection member 51 before contacting the document output drive roller 33, entry of the user's hand is restricted and contact between the user's hand and the document output drive roller 33 is suppressed. Thus, with the first exemplary embodiment, as compared with a structure in which the protection member 51 is not disposed, entry of foreign substance in the document output slot GH3*a* is suppressed.

The protection member 51 of the first exemplary embodiment includes the document guide portion 56*a*, and the document Gi is guided to the document output tray U1*a*3. In a structure where the document guide portion 56*a* is omitted, for example, if the downstream end of the document Gi with respect to the document transport direction is warped upward, i.e., curled, and the document Gi is output from the document output slot GH3*a*, the document Gi may be caught on the bottom portion 2 of the document feed tray U1*a*1 above and may cause deterioration in the stackability of the document output tray U1*a*3, a paper jam, or damage of the document Gi. In contrast, in first exemplary embodiment, the document guide portion 56*a* guides the document Gi to the document output tray U1*a*3 below, so that it is unlikely that the document Gi is caught on the document feed tray U1*a*1 and deterioration in the stackability of the document output tray U1*a*3 is reduced. Moreover, the document guide portion 56*a* has a shelter-like shape with respect to the horizontal plate portion 56, so that entry of a user's hand or foreign substances into the document output drive roller 33 is likely to be prevented and the document guide portion 56*a* has a function of protecting the document output drive roller 33.

In the first exemplary embodiment, the protection member 51 and the retard roller 23 are supported by the frame U1*a*2*c*. The upper end 52*b* of the protection member 51 with respect to the direction of gravity is disposed above, with respect to the direction of gravity, the lower end of the retard roller 23 with respect to the direction of gravity. If the upper end 52*b* of the protection member 51 with respect to the direction of gravity is disposed below the retard roller 23 with respect to the direction of gravity, a gap is formed between the protection member 51 and the retard roller 23. Therefore, for example, if a writing instrument or the like rolls down over the elevation plate 11, the writing instrument may enter the gap between the upper end 52*b* of the protection member 51 with respect to the direction of gravity and the retard roller 23, and may contact the document output drive roller 33. In contrast, in the first exemplary embodiment, the upper end 52*b* of the protection member 51 extends to a position above the lower end of the retard roller 23 with respect to the direction of gravity, so the protection member 51 protects the document output drive roller 33 from foreign substances.

Second Exemplary Embodiment

Next, a second exemplary embodiment according to the of the present invention will be described. In the description of the second exemplary embodiment, the elements the same as those of the first exemplary embodiment will be denoted by the same numerals, and detailed description of such elements will be omitted. The second exemplary embodiment is the same as the first exemplary embodiment except for the following respects.

Figure 8:
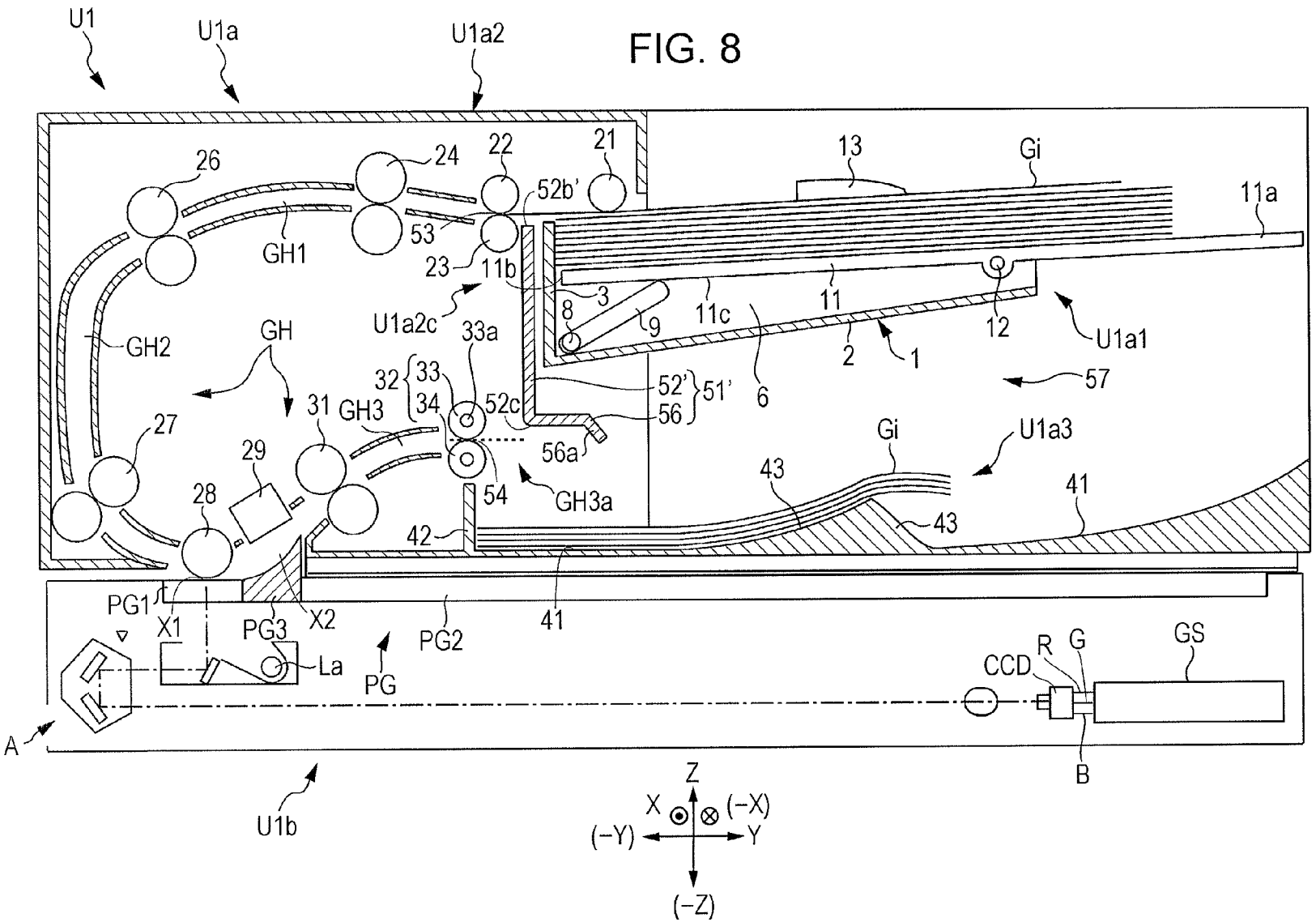
FIG. 8 is an overall view of an image reading device according to a second exemplary embodiment of the present invention, which corresponds to FIG. 3 for the first exemplary embodiment.
Figure 9:
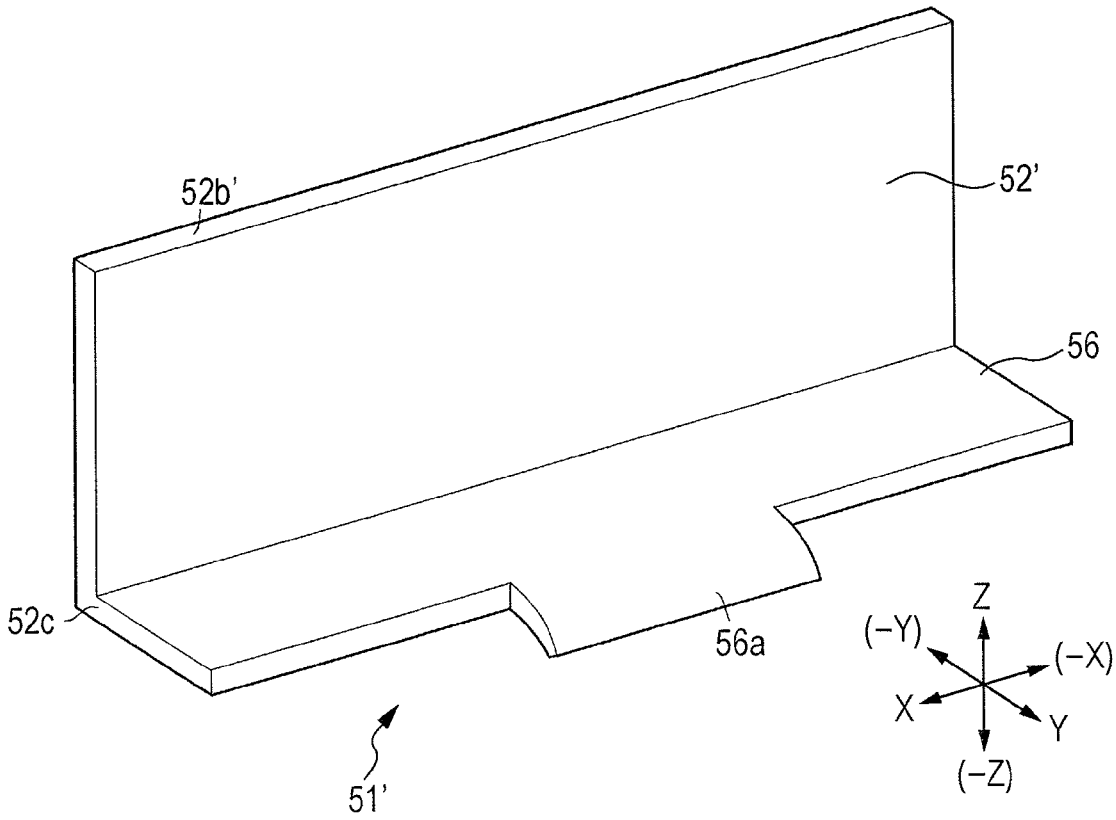
FIG. 9 is an overall perspective view of a shielding member according to the second exemplary embodiment of the present invention, which corresponds to FIG. 7 for the first exemplary embodiment.

FIG. 8 is an overall view of an image reading device according to the second exemplary embodiment of the present invention, which corresponds to FIG. 3 for the first exemplary embodiment. FIG. 9 is an overall perspective view of a shielding member according to the second exemplary embodiment of the present invention, which corresponds to FIG. 7 for the first exemplary embodiment. Referring to FIGS. 8 and 9, a protection member 51' includes a vertical plate portion 52' instead of the vertical plate portion 52 of the first exemplary embodiment. The protection member 51' is an example of a shielding member, and the vertical plate portion 52' is an example of a first shielding portion. The vertical plate portion 52' has a plate-shape similar to that of the vertical plate portion 52 of the first exemplary embodiment, except that the retard roller containing recess 52*a* is omitted. In the protection member 51' of the second exemplary embodiment, an upper part of the vertical plate portion 52' with respect to the direction of gravity is disposed between the retard roller 23 and the document feed tray U1*a*1, and the upper end 52*b*' of the vertical plate portion 52' with respect to the direction of gravity is disposed below the separation region 53 with respect to the direction of gravity. The upper end 52*b*' of the protection member 51' with respect to the direction of gravity is disposed above the lower end of the retard roller 23 with respect to the direction of gravity. The vertical plate portion 52' and the retard roller 23 are supported by the frame U1*a*2*c*.

Function of Second Exemplary Embodiment

In the image forming apparatus U according to the second exemplary embodiment having the structure described above, the protection member 51' is supported between the retard roller 23 and the document feed tray U1*a*1, so that the document output slot GH3*a* and the document output drive roller 33 are shielded from the space 57 by the protection member 51' and protected from foreign substances. That is, with the second exemplary embodiment, as with the first exemplary embodiment, entry of foreign substances in the document output slot GH3*a* is reduced. In the second exemplary embodiment, the upper end 52*b*' of the protection member 51' with respect to the direction of gravity is disposed on the right side of the retard roller 23 and above, with respect to the direction of gravity, the lower end of the retard roller 23 with respect to the direction of gravity. Therefore, with the image forming apparatus U according to the second exemplary embodiment, the protection member 51' prevents the retard roller 23 from being exposed and protects the retard roller 23, and it is unlikely that a gap is formed between the protection member 51 and the retard roller 23.

Modifications

Heretofore, the exemplary embodiments of the present invention have been described. However, the present invention is not limited to the exemplary embodiments described above, and may be modified in various ways within the spirit and scope of the present invention described in the claims. Modifications (H01) to (H09) according to the present invention will be described below.

(H01) In each of the exemplary embodiments described above, the copier U is used as an example of an image forming apparatus. However, the present invention is applicable to a multifunctional apparatus having functions of a copier, a printer, and a facsimile.

(H02) In each of the exemplary embodiments described above, the automatic document transport device U1*a* is included in the copier U. However, the present invention is applicable the copier U from which the image forming apparatus body U3 having the image recording unit U3*a*, the feed device U2, and the medium handling device U4 are omitted. That is, the present invention is applicable to the image reading device U1 as an independent device, i.e., a standalone scanner.

(H03) In each of the exemplary embodiments described above, the document guide portion 56*a* extends from the right end of the horizontal plate portion 56 to the document output tray U1*a*3. However, the structure is not limited thereto. For example, the document guide portion 56*a* may be branched from the middle portion of the horizontal plate portion 56 in the left-right direction toward the document output tray U1*a*3. For example, the second shielding portion may extend diagonally downward, and the entirety of the second shielding portion may guide the document Gi. In other words, the second shielding portion may also serve as a document guide portion.

(H04) In each of the exemplary embodiments described above, the document feed tray U1*a*1 is supported by the support arm 7 and the guided shafts 4*b* and 6*b*, and the document feed tray U1*a*1 rotates between the stacking position and the open position, which is an example of take-out position, while moving back and forth. However, the structure is not limited thereto. For example, the document feed tray U1*a*1 may be supported by the support shaft and rotate around the support shaft. As long as the document feed tray U1*a*1 is movable between the stacking position and the open position, any movement structures may be used.

(H05) In each of the exemplary embodiments described above, the elevation plate 11 of the document feed tray U1*a*1 is pushed up and down by the plate push-up portion 9. However, a mechanism for moving the elevation plate 11 is not limited thereto. For example, the elevation plate 11 may be moved up and down by being urged by a spring or the like, and the elevation plate 11 may be moved up and down while maintaining a horizontal position in an elevator-like manner, or other known elevation structures may be used.

(H06) In each of the exemplary embodiments described above, the elevation plate 11 of the document feed tray U1*a*1 is moved up and down and the document Gi is fed. However, the structure is not limited thereto. For example, the elevation plate 11 may be omitted, and the pickup roller 21 may be moved up and down to pick up the document Gi. As a further alternative, both the elevation plate 11 and the pickup roller 11 may be moved up and down.

(H07) In each of the exemplary embodiments described above, the document output drive roller 33 is used as an example of an upper output member. However, the upper output member is not limited thereto. The document output driven roller 34 may be used as an example of the upper output member, and the document output drive roller 33 may be used as the lower output member.

(H08) In each of the exemplary embodiments described above, the retard roller 23 is used as a lower feed member. However, the lower feed member is not limited thereto. For example, a pad-like retard pad may be used.

(H09) In each of the exemplary embodiments described above, the automatic document transport device U1*a* includes the image reading sensor 29. However, the structure is not limited thereto. For example, the image reading sensor 29 may be omitted from the automatic document transport device U1*a*, and only the flatbed image reading unit U1*b* having the exposure optical system A may read a document image, a reverse path may be provided, or other known structures may be used. The image reading sensor 29 may be disposed at the document reading position X1 of the automatic document transport device U1*a*, and instead of the flatbed image reading unit U1*b*, the image reading sensor 29 may read a document image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An automatic document transport device comprising:

a document stacker on which a document having a document image recorded thereon is stacked, the document stacker being supported so as to be movable between a stacking position and an open position, the stacking position being a position in which the document stacker allows the document to be stacked thereon, and the open position being a position in which a space below the document stacker with respect to a direction of gravity is opened;

a document transport path connected to the document stacker and through which the document stacked on the document stacker is transported;

a document feed member that feeds the document stacked on the document stacker to an image reading position at which the document image recorded on the document is read, the image reading position being preset on the document transport path;

a document output section to which the document is output, the document output section being disposed downstream of the document transport path with respect to a document transport direction and below the document stacker with respect to the direction of gravity;

a document output member disposed downstream of the image reading position with respect to the document transport direction, the document output member outputting the document whose document image has been read to the document output section, and the document output member including an upper output member and a lower output member, the upper output member being disposed above the document transport path with respect to the direction of gravity, and the lower output member facing the upper output member and being disposed below the document transport path with respect to the direction of gravity; and a shielding member disposed above a document output slot with respect to the direction of gravity, the document output slot being disposed at a downstream end of the document transport path with respect to the document transport direction, the shielding member being disposed between the document output member and the document output section with respect to the document transport direction, the shielding member including a first shielding portion and a second shielding portion, the first shielding portion extending upward and having a lower end with respect to the direction of gravity disposed above a region in which the upper output member and the lower output member contact each other with respect to the direction of gravity, the second shielding portion extending downstream with respect to the document transport direction from the lower end of the first shielding portion with respect to the direction of gravity, and the shielding member shielding the upper output member from a space between the document stacker and the document output section.

2. The automatic document transport device according to claim 1, wherein the document stacker includes a stacker body having an upper surface on which the document is stacked, the stacker body being movably supported between a standby position and a feed position, the standby position being a position in which the stacker body allows the document to be stacked thereon, the feed position being a position in which the document contacts the document feed member and is allowed to be fed, and the feed position being above the standby position.

3. The automatic document transport device according to claim 2, wherein the shielding member includes a document guide portion extending from the second shielding portion toward the document output section, the document guide portion guiding the document output by the document output member to the document output section.

4. The automatic document transport device according to claim 3, wherein the document feed member includes an upper feed member and a lower feed member, the upper feed member being disposed above the document transport path with respect to the direction of gravity, and the lower feed member facing the upper feed member and being disposed below the document transport path with respect to the direction of gravity, wherein the first shielding portion includes a feed member container in an upper portion thereof with respect to the direction of gravity, and an upper end of the first shielding portion with respect to the direction of gravity is disposed below a region in which the upper feed member and the lower feed member contact each other with respect to the direction of gravity, and wherein the lower feed member and the first shielding portion are supported by a frame body.

5. The automatic document transport device according to claim 3, wherein the document feed member includes an upper feed member and a lower feed member, the upper feed member being disposed above the document transport path with respect to the direction of gravity, and the lower feed member facing the upper feed member and being disposed below the document transport path with respect to the direction of gravity, wherein an upper portion of the first shielding portion with respect to the direction of gravity is disposed between the lower feed member and the document stacker, and an upper end of the first shielding portion with respect to the direction of gravity is disposed below a region in which the upper feed member and the lower feed member contact each other with respect to the direction of gravity, and wherein the lower feed member and the first shielding portion are supported by a frame body.

6. The automatic document transport device according to claim 2, wherein the document feed member includes an upper feed member and a lower feed member, the upper feed member being disposed above the document transport path with respect to the direction of gravity, and the lower feed member facing the upper feed member and being disposed below the document transport path with respect to the direction of gravity, wherein the first shielding portion includes a feed member container in an upper portion thereof with respect to the direction of gravity, and an upper end of the first shielding portion with respect to the direction of gravity is disposed below a region in which the upper feed member and the lower feed member contact each other with respect to the direction of gravity, and wherein the lower feed member and the first shielding portion are supported by a frame body.

7. The automatic document transport device according to claim 2, wherein the document feed member includes an upper feed member and a lower feed member, the upper feed member being disposed above the document transport path with respect to the direction of gravity, and the lower feed member facing the upper feed member and being disposed below the document transport path with respect to the direction of gravity, wherein an upper portion of the first shielding portion with respect to the direction of gravity is disposed between the lower feed member and the document stacker, and an upper end of the first shielding portion with respect to the direction of gravity is disposed below a region in which the upper feed member and the lower feed member contact each other with respect to the direction of gravity, and wherein the lower feed member and the first shielding portion are supported by a frame body.

8. The automatic document transport device according to claim 1, wherein the shielding member includes a document guide portion extending from the second shielding portion toward the document output section, the document guide portion guiding the document output by the document output member to the document output section.

9. The automatic document transport device according to claim 8, wherein the document feed member includes an upper feed member and a lower feed member, the upper feed member being disposed above the document transport path with respect to the direction of gravity, and the lower feed member facing the upper feed member and being disposed below the document transport path with respect to the direction of gravity, wherein the first shielding portion includes a feed member container in an upper portion thereof with respect to the direction of gravity, and an upper end of the first shielding portion with respect to the direction of gravity is disposed below a region in which the upper feed member and the lower feed member contact each other with respect to the direction of gravity, and wherein the lower feed member and the first shielding portion are supported by a frame body.

10. The automatic document transport device according to claim 8, wherein the document feed member includes an upper feed member and a lower feed member, the upper feed member being disposed above the document transport path with respect to the direction of gravity, and the lower feed member facing the upper feed member and being disposed below the document transport path with respect to the direction of gravity, wherein an upper portion of the first shielding portion with respect to the direction of gravity is disposed between the lower feed member and the document stacker, and an upper end of the first shielding portion with respect to the direction of gravity is disposed below a region in which the upper feed member and the lower feed member contact each other with respect to the direction of gravity, and wherein the lower feed member and the first shielding portion are supported by a frame body.

11. The automatic document transport device according to claim 1, wherein the document feed member includes an upper feed member and a lower feed member, the upper feed member being disposed above the document transport path with respect to the direction of gravity, and the lower feed member facing the upper feed member and being disposed below the document transport path with respect to the direction of gravity, wherein the first shielding portion includes a feed member container in an upper portion thereof with respect to the direction of gravity, and an upper end of the first shielding portion with respect to the direction of gravity is disposed below a region in which the upper feed member and the lower feed member contact each other with respect to the direction of gravity, and wherein the lower feed member and the first shielding portion are supported by a frame body.

12. The automatic document transport device according to claim 1, wherein the document feed member includes an upper feed member and a lower feed member, the upper feed member being disposed above the document transport path with respect to the direction of gravity, and the lower feed member facing the upper feed member and being disposed below the document transport path with respect to the direction of gravity, wherein an upper portion of the first shielding portion with respect to the direction of gravity is disposed between the lower feed member and the document stacker, and an upper end of the first shielding portion with respect to the direction of gravity is disposed below a region in which the upper feed member and the lower feed member contact each other with respect to the direction of gravity, and wherein the lower feed member and the first shielding portion are supported by a frame body.

13. An image reading device comprising:

the automatic document transport device according to claim 1; and an image reading unit that reads the document image at the image reading position that is preset on the document transport path of the automatic document transport device, the document image being recorded on the document that is transported by automatic document transport device.

14. An image forming apparatus comprising:

the automatic document transport device according to claim 1;

an image reading unit that reads the document image at the image reading position that is preset on the document transport path of the automatic document transport device, the document image having been recorded on the document that has been transported by automatic document transport device; and an image recording unit that records an image on a medium on the basis of the document image read by the image reading device.

* * * * *